United States Patent [19]

Laufer et al.

[11] Patent Number: 4,463,725

[45] Date of Patent: Aug. 7, 1984

[54] FUEL INJECTION DEVICE FOR INTERNAL COMBUSTION ENGINES, IN PARTICULAR A PUMP/NOZZLE FOR DIESEL ENGINES

[75] Inventors: Helmut Laufer, Stuttgart; Heinz Kuschmierz, Gerlingen, both of Fed. Rep. of Germany

[73] Assignee: Robert Bosch GmbH, Stuttgart, Fed. Rep. of Germany

[21] Appl. No.: 425,806

[22] Filed: Sep. 28, 1982

[30] Foreign Application Priority Data

Nov. 19, 1981 [DE] Fed. Rep. of Germany ..... 3145763
Jul. 2, 1982 [DE] Fed. Rep. of Germany ..... 3224769

[51] Int. Cl.[3] ..... F02M 57/02

[52] U.S. Cl. ..... 123/446; 239/88; 239/95

[58] Field of Search ..... 123/446, 447, 495; 239/88–93, 95, 533.3, 533.4, 533.5

[56] References Cited

U.S. PATENT DOCUMENTS

| | | | |
|---|---|---|---|
| 2,424,943 | 7/1947 | Nicolls | 417/387 |
| 4,092,964 | 6/1978 | Höfer et al. | 123/459 |
| 4,134,549 | 1/1979 | Perr | 239/92 |
| 4,250,857 | 2/1981 | Taplin | 239/533.5 |
| 4,279,385 | 7/1981 | Straubel et al. | 239/88 |
| 4,378,774 | 4/1983 | Kato | 123/446 |
| 4,385,609 | 5/1983 | Kato | 123/446 |
| 4,396,151 | 8/1983 | Kato et al. | 239/89 |
| 4,399,793 | 8/1983 | Poore et al. | 239/92 |

FOREIGN PATENT DOCUMENTS

| | | |
|---|---|---|
| 820823 | 11/1951 | Fed. Rep. of Germany . |
| 2558599 | 7/1977 | Fed. Rep. of Germany . |

*Primary Examiner*—Magdalen Y. C. Moy
*Attorney, Agent, or Firm*—Edwin E. Greigg

[57] ABSTRACT

A fuel injection device is proposed which has a free piston hydraulically driven by a pump piston and controlling the relieving of the pump work chamber. To this end, the free piston is embodied in two parts, comprising a control piston and a relief piston displaceable relative thereto and oriented toward the pump work chamber. The two pistons enclose between them a relief chamber, which at the end of supply can be made to communicate via a relief conduit with a chamber of lower pressure. This free piston is also usable with fuel injection pumps which supply the injection quantity via a long pressure line to the injection nozzles located on the engine; however, it is particularly advantageously usable with a pump/nozzle, in which the injection pump and the injection nozzle are combined into a single component.

14 Claims, 5 Drawing Figures

FUEL INJECTION DEVICE FOR INTERNAL COMBUSTION ENGINES, IN PARTICULAR A PUMP/NOZZLE FOR DIESEL ENGINES

BACKGROUND OF THE INVENTION

The invention is based on a fuel injection device as generally described hereinafter. Many variant embodiments of a fuel injection device of this kind are already known, the pump piston of which, moved with a constant stroke within a pump cylinder, drives a free piston operating within the same pump cylinder via a fluid column enclosed within a compensation chamber and acting as a hydraulic push rod. The quantity of fuel to be injected is pre-stored below the free piston by a metering device, and the fluid column balances out the corresponding pre-storage stroke so that either a constant supply onset determined by a fixed control opening in the pump cylinder is controlled, as is the case with a pump/nozzle as described in German Pat. No. 820,823, for example, or else a variable supply onset is controlled which is likewise independent of the injection quantity but can be influenced by separate control means. A variable supply onset of this kind is determined, in a pump/nozzle as described by German Offenlegungsschrift No. 25 58 699, by an oblique control edge on the end of the pump piston. In a pump/nozzle as shown in FIGS. 14 and 15 of U.S. Pat. No. 4,134,549, both the fuel injection quantity pre-stored below the free piston and the volume of the fluid column located in the compensation chamber are acted upon by two different fuel pressure sources, which have different supply pressures; the inflow pressure and the opening duration of inflow throttles opened at bottom dead center of the pistons, respectively, determine the quantity of fuel stored in the chambers. In all the known instances, a control edge on the free piston opens up an outflow conduit at the end of the supply stroke; as a result, the supply movement of the free piston is terminated, and the associated injection nozzle terminates the injection of fuel.

For the sake of improved power and improved exhaust emissions, a rapid needle closure is required in modern Diesel engines, and in the pump/nozzle according to German Offenlegungsschrift No. 25 58 699, this is attained by means of a pressure relief controlled by the free piston of the pressure line leading to the nozzle. A portion of the fuel located in the pump work chamber flows out into a return flow line, so that this outflow quantity must be included in the next metering of an injection quantity. Since the outflow quantities are dependent on both the rpm and the fuel injection quantity at a given time, this outflow quantity may influence the quantity metering in a disadvantageous manner if heavy demands are made on precision of metering. In the other known pump/nozzles without pressure relief of the pump work chamber, the disadvantage of a retarded end of injection occurs, causing after-injections and a worsening of the exhaust gas composition.

In order to attain optimal power over the entire rpm range and in order to adhere to the ever-more stringent requirements for preserving air quality, a fuel injection device is required which retains the known advantages of a control of the supply onset which is independent of the prestored fuel injection quantity and additionally enables the pressure relief of the pump work chamber at end of injection, without negatively affecting the precision of fuel quantity metering.

OBJECT AND SUMMARY OF THE INVENTION

The fuel injection device according to the invention has the advantage that with the free piston embodied in two parts, the relief piston oriented toward the pump work chamber executes a relief stroke at the end of injection, without any outflow quantity being lost from the pump work chamber. The metering device, which may by way of example, comprise a metering pump or a magnetic valve, needs merely to pre-store the precisely measured fuel injection quantity, without having to take consideration of pressure relief in the work chamber, when the fuel injection device is equipped in accordance with the invention.

By means of further characteristics according to the invention, the original outset position of the two-part free piston is reestablished following the relief of pressure and prior to the begining of the injection quantity metering and prior to the re-filling of the volume of the fuel column existing in the compensation chamber.

By means of the throttle restriction in the control piston according to the invention, a pressure difference is established between the first fluid column enclosed within the compensation chamber and the second fluid column enclosed within the relief chamber. As a result, a greater pressure drop is generated in the relief chamber, and a rapid pressure relief is made possible by means of the relief piston, while the pump piston during its remnant stroke between the end of injection and top dead center positively displaces the corresponding portion of the fluid column enclosed in the compensation chamber out of the outflow conduit.

The invention will be better understood and further objects and advantages thereof will become more apparent from the ensuing detailed description of three preferred embodiments taken in conjunction with the drawings.

DESCRIPTION OF THE EXEMPLARY EMBODIMENTS

Figure 1:
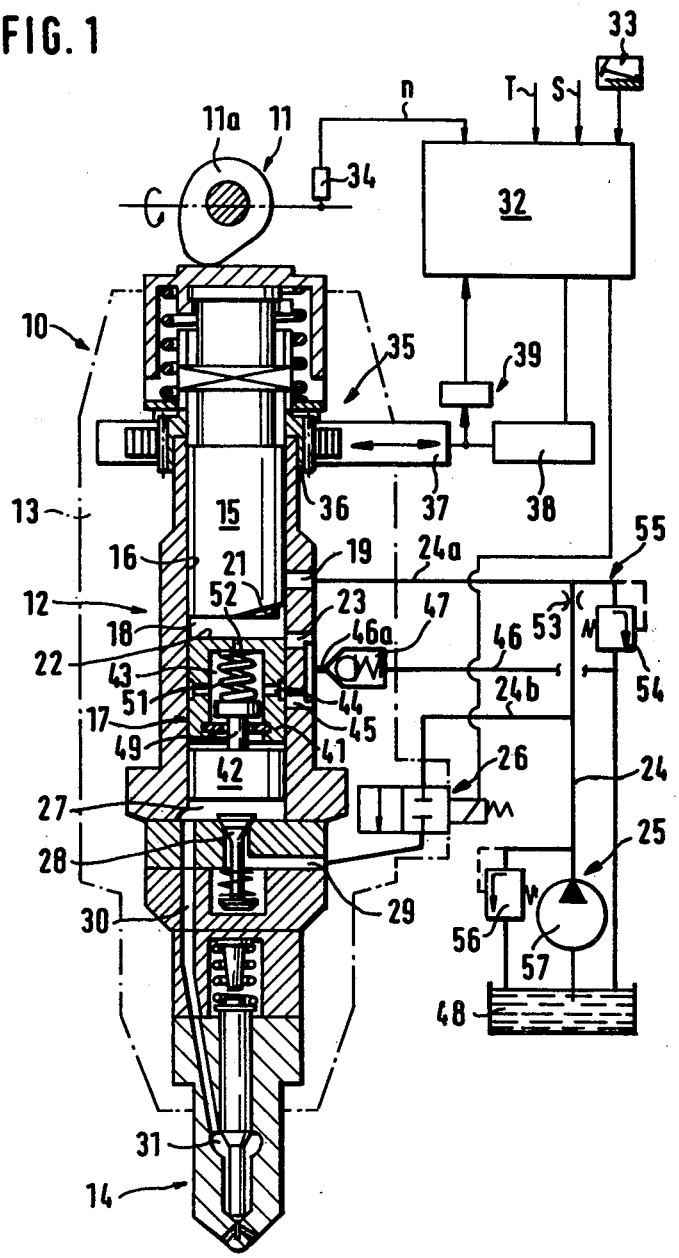
FIG. 1 shows the first exemplary embodiment of a fuel injection device, embodied as a pump/nozzle, having pistons located in a position such as they assume after the end of injection when the pump work chamber has been relieved of pressure.
Figure 2:
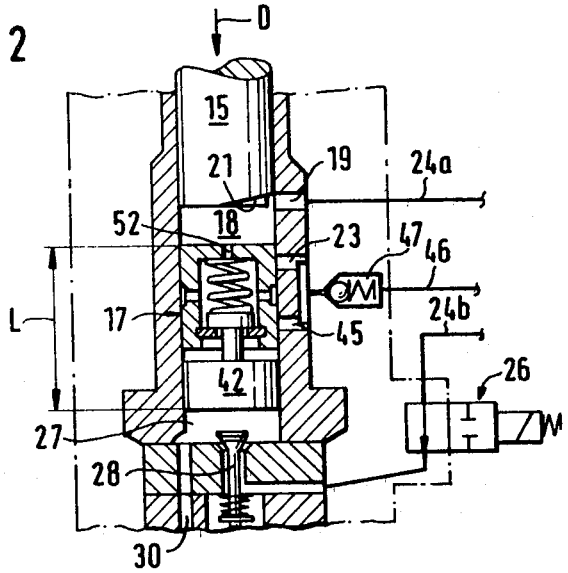
FIG. 2 is a detail of FIG. 1, having pistons located in a position prior to the onset of the compression stroke and shortly before the end of metering.

In the first exemplary embodiment of the fuel injection device according to the invention shown in FIGS. 1 and 2, reference numeral 10 designates a pump/nozzle which substantially comprises a piston-type injection pump 12 driven by a drive cam 11*a* of a drive mechanism 11, not shown in further detail, and an injection nozzle 14 combined with the pump 12 in a common housing 13. In order to simplify the illustration, the housing 13 is indicated merely by dot-dash lines.

A pump piston 15 is guided such that it is axially and rotationally movable in a pump cylinder 16 and it hydraulically drives a free piston 17 which moves within the same pump cylinder 16. This hydraulic drive is accomplished by a fluid column which functions as a hydraulic push rod or hydraulic piston rod and is enclosable in a compensation chamber 18 between the two pistons 15 and 17. Depending upon the embodiment of the corresponding pressure source, the fluid may be motor oil or, as in the present example, fuel.

The volume of the fluid column located in the compensation chamber 18, which determines the onset of supply, is controlled by a valve assembly which in the present instance comprises a supply conduit 19, located in the wall of the pump cylinder 16, and an oblique control edge 21, which is located on the end face of the pump piston 15 oriented toward the compensation chamber 18. A control edge 22 embodied by the end face of the free piston 17 oriented towards the compensation chamber 18 and by the jacket face of this free piston 17 controls the end of the supply stroke of the free piston 17 by opening a discharge conduit 23 machined into the pump cylinder 16. The supply conduit 19 is connected to a line segment 24*a* of a supply line 24, which is supplied from a low-pressure fuel source 25, this source comprising a first pressure control device 56 and a supply pump 57. The supply pump 57 also, via a line segment 24*b*, supplies a metering device 26, which pre-stores the quantity of fuel to be injected in a pump work chamber 27, subjected to the free piston 17 during its compression stroke, the pre-storage being effected via a filling conduit 29 provided with a filling valve 28. A pressure conduit 30 connects the pump work chamber 27 with a pressure chamber 31 of the injection nozzle 14. The metering device 26 is a two-position magnetic valve, and its switching duration which determines the fuel injection quantity to be pre-stored is determined by an electronic regulating control device 32, which in a known manner contains an rpm regulator or filling regulator, the set-point value of which is supplied by an accelerator pedal 33, and which processes, among other operating characteristics (operating temperature T and further signals S, for example, exhaust gas temperature, charge-air pressure in the intake line, or the exhaust gas counter-pressure), an rpm signal n from an rpm transducer 34 connected to the drive mechanism 11.

A variation of the supply onset which is dependent at least on rpm is likewise directed by the electronic regulating control device 32, by means of the rotation of the pump piston 15 by an adjusting device 35. The adjusting device 35, in a known manner, substantially comprises an adjusting pinion 36, a governor rod 37, and an electric adjusting member 38 which displaces the governor rod 37 and is combined with a position transducer 39, thus permitting the regulation of the onset of supply.

The free piston 17 is embodied in two parts in accordance with the invention and comprises a control piston 41 adjacent to the compensation chamber 18 and a relief piston 42 which is displaceable relative to the control piston 41 and is oriented toward the pump work chamber 27. Between themselves, the two pistons 41 and 42 enclose a relief chamber 43 receiving a second fluid column, which at the end of supply is connected via a relief conduit comprising a relief opening 44 in the control piston 41 and a return flow opening 45 in the wall of the pump cylinder 16, to a return flow line 46 which returns the diverted fuel to a fuel tank 48. This return flow line 46 is provided with a check valve 47 which prevents re-aspiration of the diverted fuel and if appropriately designed operates as a pressure-limiting valve, the opening pressure of which, by way of the relief piston 42 serving as movable wall during the relief of pressure, fixes the standing pressure in the pressure conduit 30 leading to the injection nozzle 14. In that case, a section 46*a* which is under the control of the valve 47, serves as a chamber of lower pressure, toward which both the compensation chamber 18 and the relief chamber 43 can be relieved.

If a relief to atmospheric pressure is desired, then the pressure limiting valve 47 may also be eliminated or may be inserted only into the connection between the discharge conduit 23 and the return flow line 46 (which alternative is not shown).

The relief piston 42 is coupled with the control piston 41 via a drag connection 49 permitting its relative motion with respect to the control piston 41 which is required for relief; a restoring spring 51 tends to press both pistons 41 and 42 into an outset position determining the maximum length L (see FIG. 2) of the free piston 17. The outset position shown in FIG. 2 is assumed by the free piston following the relief process, during the metering process and also during injection.

The relief chamber 43 communicates with the compensation chamber 18 via a throttle restriction 52 in the control piston 41 which is always open. The relief chamber 43 receiving the second fluid column therefore communicates continuously via this throttle restriction 52 with the compenstation chamber 18 containing the first fluid column. During the relief process shown in FIG. 1 for the relief chamber 43 and thus for the pump work chamber 27 and the pressure line 30, the throttle restriction 52 creates a pressure drop between the compensation chamber 18 and the relief chamber 43, assuring a very rapid and reliable relief of the pump work chamber 27. If the metering of the quantity of fuel to be injected into the pump work chamber 27 is not effected until the end of the intake stroke of the pump piston 15 by means of the two-position magnetic valve 26 used in all the illustrated embodiments, then it is necessary for the fuel pressure prevailing in the compensation chamber 18 during the metering process to be lower than the pressure of the fuel pumped from the low-pressure fuel source 25, controlled by the first pressure control device 56 and delivered via the valve 26. This is attained in the device shown in FIGS. 1 and 2 by means of a second pressure control device 55 comprising a flow throttle 53 and a pressure limiting valve 54. Thus a lower pressure prevails in the segment 24*a* of the supply line 24 than in the line segment 24*b* which leads to the magnetic valve 26. The pressure control device 55 may instead be replaced with a pressure gradient valve, which even in the case of a regulated pressure in the supply line 24 regulates a pressure in the line segment 24*a* which has been reduced by a fixed amount. Naturally the low pressure deliverd to the supply conduit 19 may also be generated by a pre-supply pump disposed preceding the supply pump 57, as in the second exemplary embodiment to be described below.

Figure 3:
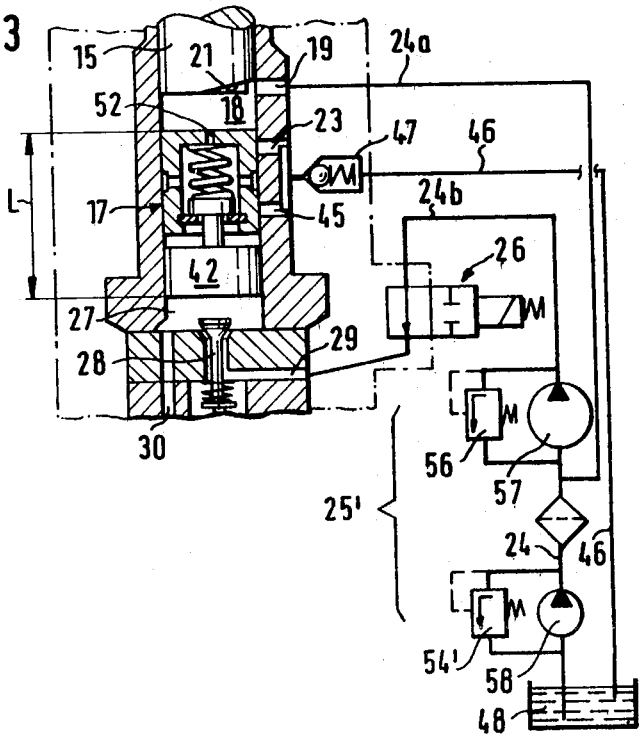
FIG. 3 is a detail corresponding to FIG. 2, but for the second exemplary embodiment, having a modified low-pressure fuel source.

The second exemplary embodiment, shown in detail in FIG. 3, differs from the first example shown in FIGS. 1 and 2 solely in a different structure of the low-pressure fuel source 25'. This component comprises the supply pump 57 supplying the pump work chamber 27 with fuel via the line segment 24b, the magnetic valve 26, the filling conduit 29 and the filling valve 28, the supply pressure of this supply pump 57 being limited by the first pressure control device 56, and a pre-supply pump 58 preceding the supply pump 57 and connected to the compensation chamber 18 via the line segment 24a and the supply conduit 19. The pre-supply pump is provided with a second pressure control device 54'. This second pressure control device 54' is adjusted to a control pressure which has been reduced by a fixed amount in comparison with the pressure of the first pressure control device 56 of supply pump 57.

Figure 4:
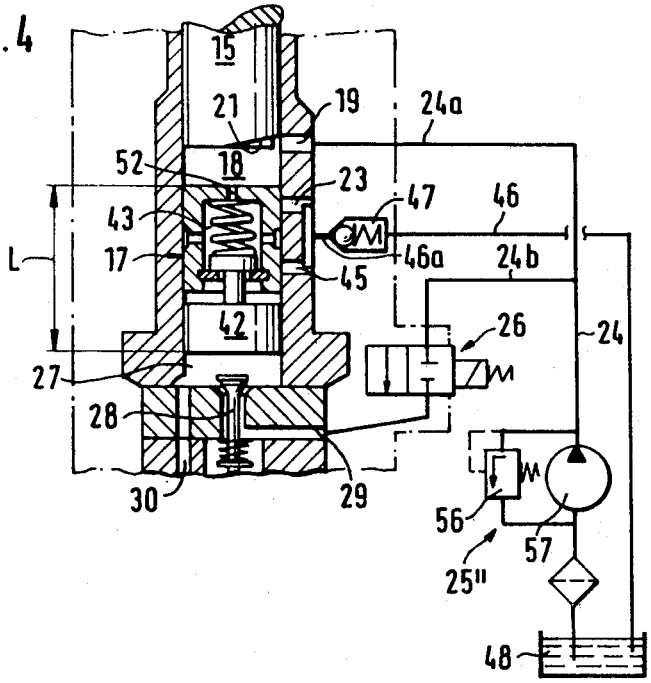
FIG. 4 is a detail corresponding to FIG. 3, but for the third exemplary embodiment, having a simplified low-pressure fuel source.

A particularly simple means of pressure supply is realized in the third exemplary embodiment shown in FIG. 4. In contrast to the exemplary embodiments described above, in which the metering of the supply quantity is effected at the end of the intake stroke, the pre-storage of the fuel quantity to be injected is effected into the pump work chamber 27 during a first portion $H_{S1}$ of the intake stroke of the pump piston 15, which begins at the latest at top dead center OT (see FIG. 5). If this mode of operation is used, the low-pressure fuel source, here marked 25'', comprises only the supply pump 57 and the pressure control device 56, embodied as a pressure-limiting valve, and not only supplies the pump work chamber 27 via the line segment 24b, the magnetic valve 26 and the filling valve 28, but also the line segment 24a supplying the compensation chamber 18 and the relief chamber 43 with fuel. The line segment 24a branches off from the supply line 24, without any additional pressure-reducing means having to be included. The return flow line 46 provided with the check valve 47 directs the fuel diverted during the relieving process out of the relief chamber 43 back to the fuel tank 48 without pressure. This simplified pressure supply is realized only by means of the method to be described in connection with FIG. 5.

Figure 5:
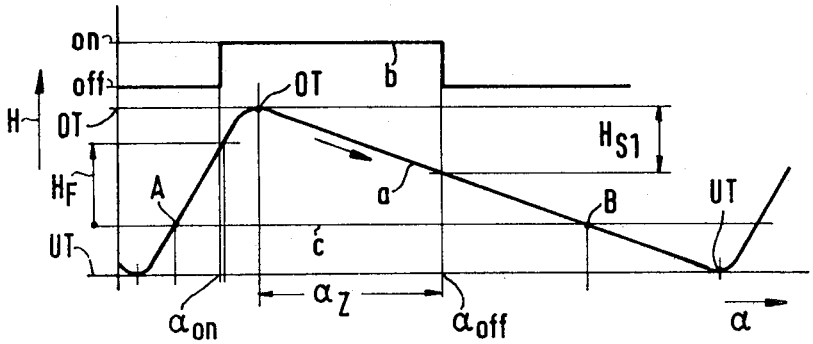
FIG. 5 is a control diagram for the third exemplary embodiment.

In the diagram shown in FIG. 5, the pump stroke H of the pump piston 15 is plotted in the ordinate over the abscissa representing the camshaft angle $\alpha$. A cam stroke curve is marked "a" and the switching status of the magnetic valve 26 is indicated by a rectangular curve "b". Although the pump/nozzle shown in all the drawing figures is shown with an overhead camshaft and a pump piston 15 which moves downward, the outset position assumed by the pump piston 15 prior to the supply stroke is designated bottom dead center UT by definition, and the position attained at the end of the stroke is designated top dead center OT by definition. $H_F$ indicates the supply stroke of the pump piston 15 which is also, at a predetermined supply onset position, traveled by the free piston 17 as well, and the metering of the supply quantity which is to be injected into the pump work chamber is effected during the first portion $H_{S1}$ of the intake stroke beginning at OT. A line characterizing the onset of supply is marked "c" and indicates that during the compression stroke, the supply stroke $H_F$ begins at point A, because the oblique control edge 21 closes the supply conduit 19, and that at point B this supply conduit 19 is reopened during the intake stroke, and the compensation chamber 18 is refilled by the begining of the next subsequent supply stroke. If as shown in FIG. 5 the cam stroke curve "a" controlled during the intake stroke between OT and UT is embodied in accordance with the illustrated example as a straight line, then a linear relationship exists between the cam angle zu traveled from OT until the instant of the closure of the magnetic valve 26 and the pre-stored injection quantity; as a result, expensive quantity measuring devices are avoided. The opening and closing instants of the magnetic valve 26 are shown in the form of angles in the abscissa, the opening instant being marked $\alpha_{auf}$ and the closing instant being marked $\alpha_{zu}$, and the respective switching positions are also marked "zu" and "auf" in the ordinate for curve b. For the metering of fuel quantities, only the instant of closing $\alpha_{zu}$ is critical. Because of the filling valve 28 which is inserted into the inlet, the magnetic valve 26 is capable of being switched over into the open position even before OT. In contrast to what is shown in FIGS. 2 and 3, the magnetic valve 26 in FIG. 4, in the illustrated UT position of the pump piston 15, is already in its closing position in which it blocks the inlet to the pump work chamber.

The mode of operation of the device according to the invention will now be explained, referring to the first exemplary embodiment shown in FIGS. 1 and 2:

In FIG. 2 the pump piston 15, after having executed its return stroke, is in its bottom dead center position; the compensation chamber 18 communicates via the supply conduit 19 with the line segment 24a, and the quantity of fuel to be injected is pre-stored in the pump work chamber 27 via the line segment 24b and the opened magnetic valve 26 and further via the filling conduit 29 in the opened filling valve 28. The free piston 17 is raised, and a portion of the fuel located in the condensation chamber 18, which depends on the pre-stored quantity, is positively displaced back into the line segment 24a via the supply conduit 19, until the magnetic valve 26 switches over into its closing position shown in FIG. 1. If the pump piston 15 then begins its compression stroke marked by an arrow D, then a further portion of the fuel located in the compensation chamber 18 is additionally positively displaced out of the supply conduit 19, until the control edge 21 of the pump piston 15 sets off this return flow and the supply stroke begins. The fluid column enclosed in the compensation chamber 18 now acts as a hydraulic push rod or as a rigid piston rod and drives the free piston 17. The free piston 17 positively displaces the supplied fuel out of the pump work chamber 27, because of the filling valve 28 which is closed after the end of metering, to the nozzle 14 via the pressure line 30 (see FIG. 1 in this respect).

As may be seen from FIG. 1, at the end of supply the control edge 22 of the free piston 17 opens up the discharge conduit 23; the free piston 17 terminates its reciprocating and supplying movement; the fuel positively displaced out of the compensation chamber 18 during the remaining stroke until top dead center flows back via the discharge conduit 23 to the tank 48, and the pressure in the relief chamber 43 is reduced as a result of the simultaneously opened relief conduit 44, 45. The relief piston 42 now executes its relief stroke until it attains the position shown in FIG. 1 and thereby relieves the pressure chamber 31 of the injection nozzle 14 communicating via the pressure conduit 30 with the pump work chamber 27. A rapid needle closure of the injection nozzle 14 is thereby attained in the desired manner.

Since in the course of pressure relief described above, no fuel escapes out of the pump work chamber 27, only the precise fuel quantity to be injected needs to be pre-stored at a given time via the metering device 26.

The second exemplary embodiment shown in FIG. 3 functions in the same manner. The mode of operation of the third exemplary embodiment has already been discussed extensively with respect to FIGS. 4 and 5.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection device for internal combustion engines, in particular a pump/nozzle for Diesel engines, having a preferably mechanically actuatable pump piston (15) guided with a constant stroke in a pump cylinder (16), a free piston (17) hydraulically driven thereby, means defining a fluid column serving as a hydraulic push rod and enclosable within a compensation chamber (18) between the two pistons (15,17), a valve assembly (19, 21) for controlling the volume, determining the supply onset, of the fluid column, a control edge (22) on the free piston (17), by means of which the compensation chamber (18) can be relieved via an outflow conduit (23) in order to terminate the supply stroke of the free piston (17), and a pump work chamber (27) communicating with the free piston (17) and via a pressure conduit (29) with an injection nozzle (14), into which chamber (27) an injection quantity of fuel withdrawn from a low-pressure fuel source (25,25',25'') is pre-stored by means of a metering device (26), wherein, the free piston (17) is embodied in two parts, comprising a control piston (41) adjacent to the compensation chamber and a relief piston (42) displaceable relative to the control piston (41) and oriented toward the pump work chamber (27), the two pistons (41, 42) enclosing a relief chamber (43) for receiving a second fluid column, the relief chamber (43) communicating at the end of supply via a relief conduit (44,45) with a chamber (46*a*) of lower pressure for permitting the relief piston (42) to execute a relief stroke without any outflow quantity being lost from the pump work chamber (27).

2. A fuel injection device as defined by claim 1, wherein, the relief piston (42) is coupled with the control piston (41) via a drag connection (49) for permitting its relative movement with respect to the control piston (41), and further comprising, a restoring spring (51) for urging both pistons (41, 42) into an outset position defining the maximum length of the free piston (17).

3. A fuel injection device as defined by claim 1 or 2, wherein, the relief chamber (43) communicates with the compensation chamber (18) via a throttle restriction (52) in the control piston (41).

4. A fuel injection device as defined by claim 1 or 2, wherein the control piston (41) is provided with a relief opening (44) serving as part of the relief conduit, the relief opening (44) communicating, in the position of the control piston (41) fixed at the end of supply by the control edge (22) of the free piston (17), with a return flow opening (45), also serving as part of the relief conduit in the wall of the pump cylinder (16).

5. A fuel injection device as defined by claim 4, wherein, the return flow opening (45) and the outflow conduit (23) are connected to a return flow line (46) containing the chamber (46*a*) of lower pressure.

6. A fuel injection device as defined by claim 5, wherein, the pressure of the fuel exiting from the compensation chamber (18) at the end of supply is limited by means of a pressure limiting valve (47) positioned in the outflow conduit (23).

7. A fuel injection device as defined by claim 5, wherein, the pressure of the fuel exiting from the compensation chamber (18) at the end of supply is limited by means of a pressure limiting valve (47) positioned in the return flow opening (45).

8. A fuel injection device as defined by claim 5, wherein, the pressure of the fuel exiting from the compensation chamber (18) at the end of supply is limited by means of a pressure limiting valve (47) positioned in the return flow line (46).

9. A fuel injection device as defined by claim 5, wherein, the pressure of the fuel exiting from the relief chamber (43) is limited by means of a pressure limiting valve (47) positioned in the outflow conduit (23).

10. A fuel injection device as defined by claim 5, wherein, the pressure of the fuel exiting from the relief chamber (43) is limited by means of a pressure limiting valve (47) positioned in the return flow opening (45).

11. A fuel injection device as defined by claim 5, wherein, the pressure of the fuel exiting from the relief chamber (43) is limited by means of a pressure limiting valve (47) positioned in the return flow line (46).

12. A fuel injection device as defined by claim 1, wherein, the compensation chamber (18) and the relief chamber (43) communicating with it are supplied with fuel from the low-pressure fuel source (25, 25'), and further comprising, a first pressure control device (56) for adjusting the pressure of the fuel delivered to the work chamber (27), and a second pressure control device (53, 54, 54') for adjusting the pressure of the fuel delivered to the compensation chamber (18) which is lower by a predetermined amount from the pressure of fuel delivered to the work chamber.

13. A fuel injection device as defined by claim 12, wherein, the low-pressure fuel source (25') comprises a supply pump (57) supplying the pump work chamber (27) and being provided with the first pressure control device (56), and a pre-supply pump (58) connected to the compensation chamber (18), preceding the supply pump (57), and being provided with the second pressure control device (54').

14. A fuel injection device as defined by claim 1, wherein, the compensation chamber (18) and the relief chamber (43) communicating with it are supplied with fuel from the low-pressure fuel source (25''), and further comprising a single pressure-control device (56) for limiting the pressure of the fuel supplied thereto to a supply pressure assuring the filling thereof, whereby the pre-storage of the quantity of fuel to be injected is controlled by the metering device (26) during a first portion ($H_S1$) of the intake stroke of the pump piston (15) which begins, at the latest, at top dead center (OT).

* * * * *